United States Patent [19]

Nissen

[11] 4,358,107

[45] Nov. 9, 1982

[54] WEIGHT LIFTING MACHINE

[76] Inventor: George P. Nissen, c/o Nissen Corporation, 930 - 27th Ave. SW., Cedar Rapids, Iowa 52406

[21] Appl. No.: 122,373

[22] Filed: Feb. 19, 1980

[51] Int. Cl.[3] ..... A63B 21/06

[52] U.S. Cl. ..... 272/118; 272/136; 272/140

[58] Field of Search ..... 272/118, 117, 136, 138, 272/140, 142, 93, 134, 135

[56] References Cited

U.S. PATENT DOCUMENTS 1,139,126 5/1915 Kerns ..... 272/140
3,905,599 9/1975 Mazman ..... 272/118
4,208,049 6/1980 Wilson ..... 272/138

*Primary Examiner*—Richard C. Pinkham
*Assistant Examiner*—William R. Browne
*Attorney, Agent, or Firm*—Haven E. Simmons; James C. Nemmers

[57] ABSTRACT

A weight lifting machine substitutes a noncumulative force or constant tension type spring for some of the individual weights with which the machine would otherwise be equipped, the tension required to unwind the spring being equal to the sum of the omitted weights. The remaining individual weights function as before but when additional resistance, greater than their sum, is wanted, the spring is connected into the lifting mechanism.

3 Claims, 2 Drawing Figures

WEIGHT LIFTING MACHINE

BACKGROUND OF THE INVENTION

Weight lifting machines which employ a stack of individual weights, one or more of which can be "ganged" together to provide successively greater resistance, are common and well-known for physical fitness purposes. One disadvantage of these machines is their bulk and overall weight arising, of course, from the heavy stack (and sometimes stacks) of individual, graduated weights which they incorporate. With this in mind, some have tried substituting various combinations of springs and linkages, often coupled with gauges, for the weight stacks in order to reduce the bulk and weight of the machines concerned. But these substitutions seem never to have "caught on", as it were, perhaps because they in effect eliminate the psychological motivation that a physically large, heavy stack of weights provides a person who confronts their lifting. One wants a "large mass" to move as he lifts and the greater and bulkier the mass he is able to displace, the greater the satisfaction he obtains from the effort required. Hence the primary object of the present invention is a reduction in the bulk of current weight lifting machines without at the same time impairing the psychological motivation and satisfaction they provide.

SUMMARY OF THE INVENTION

The invention takes advantage of the fact that many of the individual weights in the typical weight lifting machine are rarely if ever actually used. For instance, suppose the machine is equipped with a stack of twenty weights of ten pounds each. It is unusual, in most or at least many cases, that more than, say, the upper ten of these, the 10 to 100 pound range, are used at any one time. The invention therefore substitutes for the lower ten weights, that is, the 100 to 200 pound range, a spirally wound, non-cumulative force ribbon spring having a 100 pound strength. As is well known, a spring of this type is wound in such a manner that it provides a constant, rather than an increasing, tension as it is unwound. Hence when its free end is secured to the lifting member to which the individual weights are also securable, an additional 100 pounds of resistance is immediately available. Then keying one or more of the individual weights to the lifting member provides the 110 to 200 pound range in 10 pound increments. Thus the bulk and overall shipping weight of the machine is materially reduced without at the same time reducing the psychological effect and satisfaction it provides its users.

DETAILED DESCRIPTION OF THE PREFERRED EMBODIMENT

Figure 1:
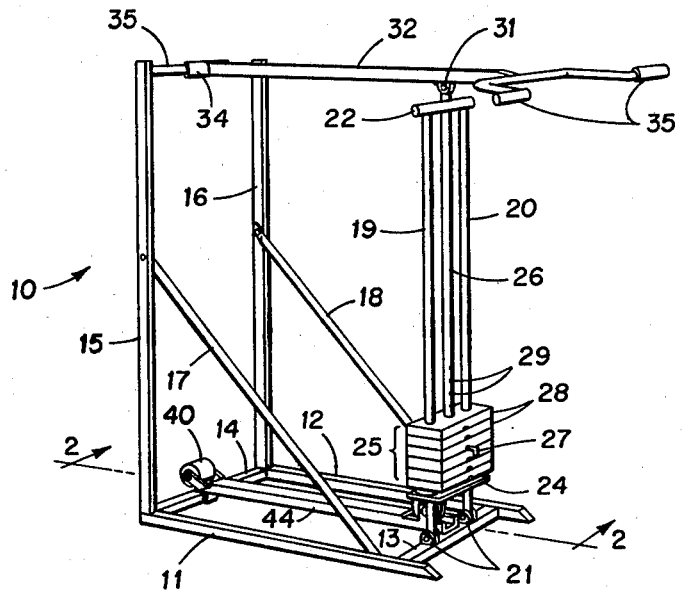
FIG. 1 is a perspective view of a typical weight lifting machine showing the present invention incorporated therein.
Figure 2:
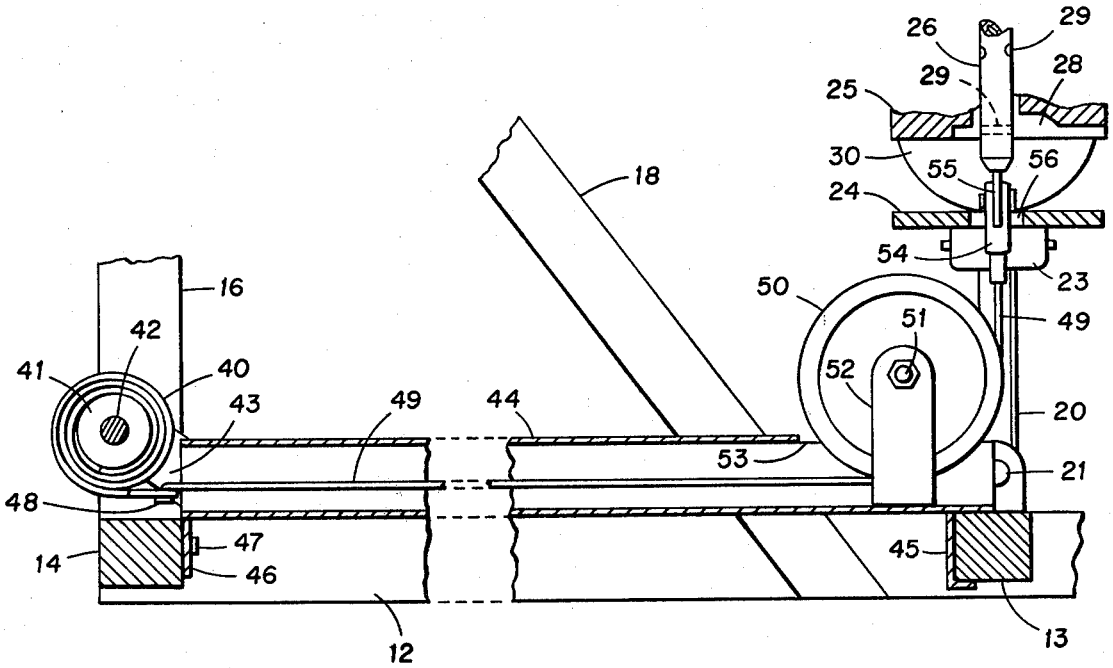
FIG. 2 is a sectional view taken along the line 2—2 of FIG. 1 and illustrating details of the non-cumulative force spring application.

The illustrated weight lifting machine, generally designated at 10, comprises a rectangular framing consisting of base side members 11 and 12, base front and rear members 13 and 14, and rear upright members 15 and 16, the latter being supported by brace members 17 and 18. To improve stability the lower faces of the front and rear base members 13 and 14 are slightly spaced above the floor (see FIG. 2) relative to the base side members 11 and 12 so that the machine sits upon the latter two members only. An upright, laterally spaced pair of weight guide bars 19 and 20 are pivoted at 21 at their lower ends to the top face of the front base member 13 and are joined at their upper ends by a tie member 22. Each guide member 19 and 20, just above its lower end, is fitted with a stop collar 23 (only one being shown in FIG. 2) upon which rests a horizontal weight support plate 24. The guide bars 19 and 20 extend up through the plate 24 and a stack of typical cast iron weights 25 of graduated values. The weights 25 are slidable on the guide bars 19 and 20 and on an upright weight selector bar 26 between the former two bars which passes centrally up through the weights 25. The lowermost of a selected number of the weights 25, however, can be engaged with the selector bar 26 by means of a cranked key 27 extending inwardly from the front face of the weights 25 through a recess 28 casted integrally in the bottom face of each weight 25, the key 27 passing in turn through one of a number of apertures 29 through and appropriately spaced along the selector bar 26. Hence, lifting the latter bar will lift all of the weights 25 above the key 27 as a unit while leaving those below the key 27 undisturbed. In order to avoid shock, should the selector bar 26 be suddenly released when elevated, a pair of cushions 30 encircle the guide bars 19 and 20 between the plate 24 and the lowermost weight 25. The upper end of the selector bar 26 passes slidably up through the tie member 22 and is pivotally secured at 31 intermediate the ends of an operating member in the form of a fore-and-aft lifting arm 32. The latter is equipped at its forward end with a pair of splayed handles 33 and journaled at its rear end at 34 about a tie bar 35 between the rear upright members 15 and 16. Hence, when the handles 33 and thereby the lifting arm 32 and selector bar 26 are raised by the user's arms, the bar 26 will in turn elevate those of the weights 25 above the key 27, the guide bar pivots 21 accommodating the guide bars 19 and 20 and the weights 25 to the rotational arc of the lifting arm 32 about the tie bar 35. All the foregoing is essential conventional and well known so that other details of the machine 10 need not be recounted.

As previously noted, the invention reduces the number of weights 25 necessary for the machine 10 by substituting for the omitted weights a non-cumulative force or constant tension spring or springs. Such springs are shown and discussed, for instance, in U.S. Pat. Nos. 2,609,191; 2,609,192; 2,609,193; 2,647,743; and 3,291,474, and have found many applications in a wide variety of settings. The self winding spring 40 used in the present invention is of the coiled ribbon type having its convolutions in a common radial plane, and supported on and free to revolve relative to a bobbin 41. The latter is journaled on a transverse axle 42 carried between a pair of bracket arms 43 extending upwardly from the rear side walls of an open-ended, rectangular housing 44. The housing 44 sits centrally on and extends horizontally between the front and rear base members 13 and 14, being retained at its front end by a depending L-shaped tongue 45 engaging the bottom of the front base member 13 and at it rear end by a depending tang 46 bolted at 47 to the rear base member 14. The outer free end of the spring 40 is appropriately secured at 48 to one end of a steel cable which extends forwardly through the housing 44 and under a pulley 50 journaled on a transverse axle 51 carried between a second pair of bracket arms 52 upstanding from the front bottom wall of the housing 44, the top wall of the latter being cut back at 53 for this purpose. The pulley 50 is disposed so that the cable 49, after passing under the former, thence extends upwards directly beneath the lower end of the selector bar 26 where its other end is fitted with a clevis 54 removably pinned to a tang 55 depending from the bar 26 through an aperture 56 in the plate 24. Hence upward movement of the selector bar 26 will cause the cable 49 to unwind the spring 40 into the housing 44, the resistance of the latter being uniform throughout movement of the bar 26 and cable 49.

Accordingly, the spring 40 is thereby substituted for the number of weights equal to its strength and so reduces bulk and shipping costs of the machine 10. During normal use of the latter the clevis 54 is disconnected from the tang 55 and therefore the weights 25 alone employed. Only when additional resistance is wanted is the spring 40 in effect added to the weights 25 in order to "shift," as it were, from a lower range provided by the weights 25 alone to a higher range provided by the latter in conjunction with the spring 40. The housing 44 is a safeguard in the event the spring 40 or the cable 49 should break, as well as serving as a mounting for the parts involved so that the latter can be supplied as a separate sub-assembly, either for incorporation into a machine initially or for installation later on one already in the field. As will be apparent to those skilled in the art, various other means of activating the spring 40 could be employed which would avoid having manually to attach and detach the selector bar 26 and cable 49. A foot operated clutching arrangement, for instance, would allow one quickly and easily to shift between one range and the other with somewhat the same effect as shifting gears on a multi-speed bicycle between the "slower but easier" range and the "faster but harder" range. Conceivably, also, an additional spring or springs of different strengths could be employed to give a variety of combinations in conjunction with the individual weights 25.

In any event, though the present invention has been described in terms of a particular embodiment, being the best mode known of carrying out the invention, it is not limited to that embodiment alone. Instead, the following claims are to be read as encompassing all adaptations and modifications of the invention falling within its spirit and scope.

I claim:

1. In a weight lifting machine having an upright frame including a pair of elongated generally upright laterally spaced weight guide members pivoted at their lower ends to the frame, a stack of discrete graduated weights supported on the guide members adjacent their lower ends, the weight guide members extending through the stack of weights at horizontally spaced locations thereon, each of the weights being slidable on the guide members, an elongated generally upright selector member, the lower end portion of the selector member extending slidably through the weight stack at a location between the guide members therethrough, the selector member including a plurality of transverse apertures spaced longitudinally thereof at locations corresponding to locations between adjacent ones of the weights, means insertable between an adjacent pair of the weights and through the selector member aperture therebetween in order to provide a selected one or ones of the weights, the selector member and the weights so selected being liftable relative to the guide members and the non-selected weights of the stack, and a generally horizontal lifting member having an end pivoted to the frame and having means at another end for lifting movement of the lifting member by the limb or limbs of a trainee, the lifting member being pivoted intermediate its ends to the upper end of the selector member, whereby lifting movement of the lifting member causes pivoting movement of the guide members and the weight stack about said guide member lower end pivots, the improvement comprising: at least one spring assembly carried by the frame including at least one unwindable and self-winding spring of the non-cumulative forced type having a free end, unwinding of the spring by its free end being resisted by a pre-determined constant tension throughout substantially all said unwinding, the spring being generally horizontally offset from the selector member and weight stack, a flexible member connected at one end to said spring end, the flexible member passing over pulley means disposed beneath the lower end of the selector member and having its other end releasably connected to the lower end of the selector member effective to unwind the spring against said tension upon lifting of the selector member and said selected weights by the lifting member as aforesaid.

2. The machine of claim 1 wherein the frame includes opposite base portions, one of said portions being disposed generally beneath the selector member and the other of said portions being horizontally offset from the selector member, and wherein the spring assembly includes an elongated housing disposed between and on the base portions, the spring being carried by the housing at a location thereon adjacent said horizontally offset base portion, the spring member extending into and through the housing upon its unwinding as aforesaid, the pulley means being carried by the housing at a location thereon beneath the selector member for rotation about a horizontal axis transversely of the housing.

3. The machine of claim 2 wherein said spring member comprises a plurality of convolutions disposed in a substantially common radial plane, the spring member being mounted on a cylindrical member carried by said housing and being free for rotation about its axis relative to the cylindrical member upon its unwinding and winding as aforesaid, the outer end of the spring member constituting said free end thereof.

* * * * *